US005840473A

United States Patent [19]

Mydlarz et al.

[11] Patent Number: 5,840,473

[45] Date of Patent: Nov. 24, 1998

[54] MIXED EMULSIONS OF DIFFERENT SPEED PROPERTIES USING SULFINATE AND SULFONATE COMPOUNDS

[75] Inventors: Jerzy Z. Mydlarz, Fairport; Roger L. Klaus; Frederick C. Derks, both of Rochester, all of N.Y.

[73] Assignee: Eastman Kodak Company, Rochester, N.Y.

[21] Appl. No.: 841,546

[22] Filed: Apr. 23, 1997

[51] Int. Cl.[6] ..... G03C 1/36; G03C 1/09

[52] U.S. Cl. ..... 430/509; 430/603; 430/606; 430/611; 430/599; 430/605

[58] Field of Search ..... 430/603, 606, 430/611, 509, 599, 605

[56] References Cited

U.S. PATENT DOCUMENTS

| | | | |
|---|---|---|---|
| 4,301,242 | 11/1981 | Patzold et al. | 430/569 |
| 4,362,806 | 12/1982 | Whitmore | 430/202 |
| 5,039,601 | 8/1991 | Ohya et al. | 430/569 |
| 5,219,721 | 6/1993 | Klaus et al. | 430/569 |
| 5,292,635 | 3/1994 | Lok | 430/611 |
| 5,295,635 | 3/1994 | Niedospial, Jr. et al. | 242/74 |
| 5,360,712 | 11/1994 | Olm et al. | 430/567 |
| 5,418,118 | 5/1995 | Edwards et al. | 430/506 |
| 5,418,127 | 5/1995 | Budz et al. | 430/611 |
| 5,443,947 | 8/1995 | Lok | 430/569 |
| 5,457,021 | 10/1995 | Olm et al. | 430/567 |
| 5,462,849 | 10/1995 | Kuromoto et al. | 430/567 |

OTHER PUBLICATIONS

Research Disclosure, No. 38957, Sep. 1996, pp. 591–639.
Chemical Abstracts, vol. 59, 9776e.
Jeffrey D. Macke & Lamar Field, Journal of Organic Chemistry, vol. 53, pp. 396–402, 1988.

*Primary Examiner*—Mark F. Huff
*Attorney, Agent, or Firm*—Paul A. Leipold

[57] ABSTRACT

The invention relates to a photographic element comprising at least two photographic emulsions wherein the grains of said at least two emulsions are the same and wherein at least one of said at least two emulsions is treated with a speed decreasing compound of Formula I:

$$Z^1—X^1O_2S—M^1 \quad (I)$$

and a compound of Formula II:

$$Z^2—X^2O_x—M^2 \quad (II)$$

wherein $X^1$ is sulfur and $X^2$ is selected from the group consisting of sulfur and selenium, $M^1$ and $M^2$ are independently selected from group consisting of a metal ion and wherein $R^1$, $R^2$, $R^3$ and $R^4$ are independently selected from the group consisting of hydrogen and an alkyl of 1–3 carbon atoms, and $Z^1$ and $Z^2$ are independently selected from the group consisting of an unsubstituted or substituted alkyl of 1 to 18 carbon atoms, an unsubstituted or substituted aryl group having 6 to 10 carbon atoms, an unsubstituted or substituted 5-membered or 6-membered heterocyclic group having one or two heteroatoms, and L, wherein L is a divalent linking group, provided that, if $Z^1$ is L, the compound of Formula I is a polymer and, if $Z^2$ is L, the compound of Formula II is a polymer.

11 Claims, No Drawings

MIXED EMULSIONS OF DIFFERENT SPEED PROPERTIES USING SULFINATE AND SULFONATE COMPOUNDS

FIELD OF THE INVENTION

This invention relates to photographic elements. It particularly relates to silver halide emulsions of different speed properties mixed in the same photographic layer.

BACKGROUND OF THE INVENTION

There is a continuing need for methods to control the speed and curve shape of photographic emulsions. Typical methods for achieving slower emulsion records are utilizing smaller grain size emulsions, underfinishing, adding more sensitizing dyes, doping with metal complexes, or using filter dyes.

It has been known to control the properties of a photographic element by coating separate layers, belonging to the same color record, in so-called double-coat or triple-coat layers. These separate layers typically contain differently sized emulsions that have different sensitivities and different amount of chemicals such as sensitizing dyes, chemical sensitizers, or antifoggants. The imaging output of these individual layers can then be modulated by decreasing or increasing the level of imaging coupler copresent in the layer or by decreasing or increasing the level of inhibiting coupler copresent in the layer. The final effect of a double-coat or triple-coat color record is to achieve an overall latitude and improved curve shape relative to that achieved by a single emulsion in a single layer for a single color record.

It has also been known to control the properties of a photographic element by blending fast and slow emulsions in the same layer in a given color record. The effect of blending emulsions has been to provide latitude and improved curve shape relative to a single emulsion. This is because the faster emulsion provides improved lower scale performance thereby providing better detail in the lower exposure region of the image. The slower emulsion provides improved higher scale performance thereby providing improved detail in the high density region of the photographic image. Sometimes a moderately sensitive emulsion is also utilized in a photographic element to improve detail in the middle density region of a photographic image.

Both of these techniques to obtain a color record or multiple color records in a photographic element are used to achieve greater exposure latitude and improved sensitometric characteristic curve shape not attainable by using only one emulsion of a given sensitivity in a given color record.

In order to form the faster and middle and slower emulsions, it has been necessary to utilize larger grains for the fast emulsions, smaller grains for the middle emulsions, and even smaller grains for the slower emulsions in a single color record. When emulsions of these different sizes are then blended into a single layer or are coated separately to form double-coat or triple-coat layers, the smaller size emulsion having greater surface area requires a greater amount of dye for sensitization, as well as a greater amount of chemicals utilized for chemical sensitization and image formation, such as dye image-forming couplers. Further, in the manufacture of such elements, there are required a multiplicity of apparatus for forming the different size emulsions, their handling, and treatment prior to formation into photographic elements.

PROBLEM TO BE SOLVED BY THE INVENTION

There is a need to provide simplified photographic elements not requiring as many separate emulsions to be formed. There is also a need to lower the usage of other chemicals in the photographic elements.

SUMMARY OF THE INVENTION

An object of the invention is to overcome disadvantages of prior photographic elements.

Another object is to provide lower cost photographic elements.

A further object is to provide emulsions that are more stable during holding in manufacture prior to being formed into photographic elements.

These and other objects of the invention are accomplished by a photographic element comprising at least two photographic emulsions wherein the grains of said at least two emulsions are the same and wherein at least one of said at least two emulsions is treated with a speed decreasing compound of Formula I:

$$Z^1—X^1O_2S—M^1 \quad (I)$$

and a compound of Formula II:

$$Z^2—X^2O_2—M^2 \quad (II)$$

wherein $X^1$ is sulfur and $X^2$ is selected from the group consisting of sulfur and selenium, $M^1$ and $M^2$ are independently selected from group consisting of a metal ion and

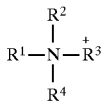

wherein $R^1$, $R^2$, $R^3$ and $R^4$ are independently selected from the group consisting of hydrogen and an alkyl of 1–3 carbon atoms, and $Z^1$ and $Z^2$ are independently selected from the group consisting of an unsubstituted or substituted alkyl of 1 to 18 carbon atoms, an unsubstituted or substituted aryl group having 6 to 10 carbon atoms, an unsubstituted or substituted 5-membered or 6-membered heterocyclic group having one or two heteroatoms, and L, wherein L is a divalent linking group, provided that, if $Z^1$ is L, the compound of Formula I is a polymer and, if $Z^1$ is L, the compound of Formula II is a polymer.

Another embodiment of the invention is accomplished by a method of sensitization comprising forming an emulsion, adding chemical sensitizers and heating to sensitize, then adding speed decreasing compound wherein said speed decreasing compound is present in an amount to provide greater than 0.1 log E decrease in speed.

ADVANTAGEOUS EFFECT OF THE INVENTION

The invention provides lower cost manufacturing of photographic elements by simplifying manufacture of the emulsions utilized in the photographic elements, as well as requiring lower chemical use in the formation of the photographic elements. The invention is particularly advantageous when used in a single color record.

DETAILED DESCRIPTION OF THE INVENTION

The invention provides numerous improvements over prior methods of photographic element manufacture and prior photographic elements. The method of the invention requires fewer emulsions in the manufacture of the photographic element, thereby decreasing the amount of equipment required to manufacture the emulsions for the photographic elements. The photographic elements of the invention require lower chemical usage such as chemical sensitizers, spectral sensitizers, and photographic couplers. The photographic elements of the invention utilizing fewer emulsions in a single color record provide for easier control of the curve shape and latitude of the elements. The photographic elements of the invention using less spectral sensitizing dye are less susceptible to staining, as there is less dye to wash out or decolorize during processing and less residual dye remaining after processing to develop images.

An advantage of utilizing the same emulsion adjusted to a different speed versus using separate emulsions in a single color record is that the emulsions have the same reciprocity characteristics and a change in the blend ratio of the faster and slower emulsions or amount in the double-coat or triple-coat layers does not change the reciprocity characteristics. In the prior photographic elements utilizing different emulsions, each change of, for example, the blend ratio resulted in a change in the overall reciprocity of the photographic element. The prior techniques for changing emulsion properties included adding metal dopants or underfinishing by either using less chemical sensitizer in one emulsion or not heating to provide complete chemical sensitization. The invention also has the advantage that as each emulsion in the blend or in the double-coat or triple-coat has the same composition, including spectral sensitizer, the spectral sensitivity is the same for each emulsion regardless of the blend that is carried out to achieve a desired curve shape. A single color record means the emulsions are sensitized to the same color sensitivity. For example, all emulsions sensitized to red form the red color record for red exposure and are combined in a layer with cyan dye forming couplers.

The phrase "same emulsion" indicates that the two emulsions have the identical composition, grain size, morphology, dispersity, and architecture. Grain composition refers to the silver halide composition, as well as the chemical composition of other materials added during grain formation such as dopants and ripeners. Grain architecture refers to structure elements such as bands of different compositions, and epitaxy. In some embodiments of the same invention, the "same emulsion" will also have identical surface treatments such as spectral sensitization, antifoggant treatment, chemical sensitization, and reciprocity dopants. In other embodiments the "same emulsion" will be subjected to differing surface treatments where different amounts or compositions of spectral sensitizers may be utilized, different amounts and types of antifoggants may be utilized, and different amounts and types of reciprocity dopants may be utilized.

Any speed decreasing compound may be utilized in this invention that does not significantly affect the reciprocity, incubation and keeping characteristics, curve shape, developablity, spectral sensitivity, and fog. The suitable compounds for this invention are those such as described in U.S. Pat. No. 5,292,635 and have the general structure:

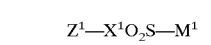

$$Z^1—X^1O_2S—M^1 \quad \text{(Formula I)}$$

and

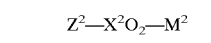

$$Z^2—X^2O_2—M^2 \quad \text{(Formula II)}$$

wherein $X^1$ is sulfur and $X^2$ is selected from the group consisting of sulfur and selenium, $M^1$ and $M^2$ are independently selected from group consisting of a metal ion and

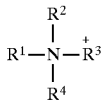

wherein $R^1$, $R^2$, $R^3$ and $R^4$ are independently selected from the group consisting of hydrogen and an alkyl of 1–3 carbon atoms, and $Z^1$ and $Z^2$ are independently selected from the group consisting of an unsubstituted or substituted alkyl of 1 to 22 carbon atoms, an alkenyl of 2 to 22 carbon atoms, an alkynyl of 2 to 22 carbon atoms, an unsubstituted or substituted aryl group having 6 to 20 carbon atoms, an unsubstituted or substituted 5 to 15-membered heterocyclic group having one or two heteroatoms, and L, wherein L is a divalent linking group. Examples of suitable aryl groups are phenyl, tolyl, naphthyl, cycloheptatrienyl, cyclooctatrienyl, and cyclononatrienyl. Examples of suitable heterocyclic groups are pyrrolyl, furanyl, tetrahydrofuranyl, thiofuranyl, pyridino, picolino, piperidino, morpholino, pyrrolidino, thiophene, oxazole, thiazole, imidazole, selenazole, tellurazole, triazole, tetrazole, and oxadiazole. Examples of suitable L groups are $—(CH(CH_2)—_m)—$ where m=1 to 11, $—(CH—CH=CH—CH_2)—$, and $—(C(CH_3)CH_2)—$. When $Z^1$ or $Z^2$ is L, the compound of formula I or II, respectively, is polymeric, with the repeating unit being of Formula I or Formula II, respectively.

In a preferred embodiment, $X^1$ and $X^2$ are sulfur, $M^1$ and $M^2$ are independently selected from $Na^+$, $K^+$ and

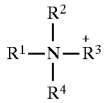

and $Z^1$ and $Z^2$ are independently selected from an unsubstituted phenyl group or a phenyl group substituted in one or two positions independently with a functional group selected the group consisting of an alkyl having 1 to 10 carbon atoms, an alkoxy having 1 to 10 carbon atoms, an acyl having 1 to 10 carbon atoms, an hydroxyl, a phenyl, a tolyl, a naphthyl, a carboxy, a chloro, a bromo, a nitro, a cyano, an acetamido, a carbamoyl, an ureido, an unsubstituted amino, and an amino substituted with one or two alkyls being the same or different and each having 1 to 3 carbon atoms. In a more preferred embodiment, $M^1$ and $M^2$ are each $Na^+$ or $K^+$, and $Z^1$ and $Z^2$ are each a tolyl group. Most preferred are the $Na^+$ or $K^+$ salts of p-toluene thiosulfonate and p-toluene sulfinate.

Compounds of Formula I and II can be synthesized by methods known in the art and described, for example, in *Journal of Organic Chemistry,* vol.53, p.396 (1988) and *Chemical Abstracts,* vol.59, 9776e. The most preferred compounds, sodium or potassium p-toluene thiosulfonate and p-toluenesulfinate, are commercially available.

Other closely related thiosulfonate containing compounds and labile disulfides are applicable for the practice of this invention. Examples of such are those described in U.S. Pat. No. 5,443,947, and they are included here by reference.

The speed decreasing compounds of Formula I and II may be utilized in any suitable amount Generally the speed decreasing compound is used in an amount that will result in greater than 0.1 log E decrease in speed. In a preferred embodiment the decrease in speed will be between about 0.2 and 1.2 log E.

The amount of speed decreasing compounds of Formula I and II utilized may be any amount. Typical is an amount of between about $1\times10^{-2}$ g and about 50 g per silver mol. The preferred amount is between about $1\times10^{-1}$ g and 10 g per silver mol. The specific preferred amount of speed decreasing compound will depend on the structure of the speed decreasing compound, on the nature of the silver halide emulsion acted on and the amount of speed reduction desired.

The mixed grain emulsions of the invention may be utilized in any typical photographic element. These include color negative films, color paper utilizing negative emulsions, transparencies utilizing reversal imaging, and black-and-white films and papers, especially duplitized x-ray recording films. They can be single color elements or multicolor elements. The use in color negative films is preferred, as these films have more than one speed emulsion in a single color record. Such color negative films may have a slow speed, high speed, and medium speed emulsion in the same color record. Multicolor elements typically contain dye image-forming units sensitive to each of the three primary regions of the visible spectrum. Each of the three primary regions form a single color record. The preferred use of the invention is when at least two layers of a single color record use the same emulsion and at least one is treated with a speed reducing compound. Each unit can be comprised of a single emulsion layer composed of blended emulsions or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. This invention may be particularly useful with those photographic elements containing a magnetic backing such as described in No. 34390, *Research Disclosure,* November 1992.

The emulsion grains in their preparation may be carried out by any of the known techniques in the art. Such techniques are disclosed in *Research Disclosure* No. 38957 of September 1996, at page 590–595.

The grains of the invention may be sensitized both chemically and spectrally by any of the known techniques in the art. Typical of such techniques are those disclosed at *Research Disclosure* No. 38957 at Sections IV and V, pages 601–607.

The emulsions of the invention are typically provided with melt hold stabilizing addenda during the coating operation. Typical of such addenda are the soluble palladium(II) complexes Preferred are those such as the ethylenediamine complex of tetrachloropalladate.

It is further within the invention to adjust the properties of the grains by the use of antifoggants and stabilizers such as well known in the art. Such materials are those disclosed at *Research Disclosure* No. 38957, Section VII at page 607–610. The photographic elements using the emulsions of the invention further may make use of any appropriate coating aids such as plasticizers, lubricants, antistats and matting agents such as disclosed at Section IX of *Research Disclosure* No. 38957, pages 612–616. As is apparent from the discussion above, the invention is primarily directed to the adjustment of properties by the use of a speed modifying compound to decrease the speed of at least one of the emulsions in a set of a single color record. These emulsion sets are believed to find wide use among all silver halide photographic elements and with a variety of silver halide compositions.

The following examples illustrate the practice of this invention. They are not intended to be exhaustive of all possible variations of the invention. Parts and percentages are by weight unless otherwise indicated.

EXAMPLES

Elements in accordance with the present invention were made by adding compounds of Formula I and II [potassium p-toluene thiosulfonate (TSS) and sodium p-toluene sulfinate (TS)] simultaneously to chemically and spectrally sensitized emulsions. In each case the ratio by the weight of TSS and TS was the same and equal to 10:1.

The following compounds are utilized in the Examples.

Sensitizing Dye A =

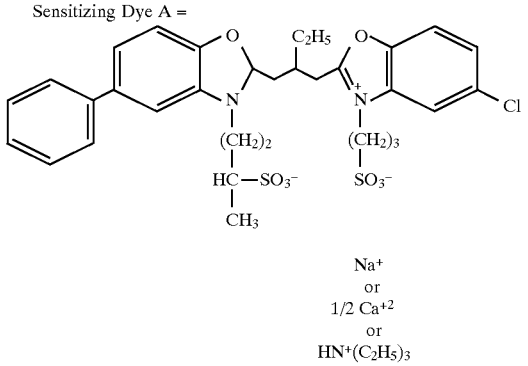

Sensitizing Dye B =

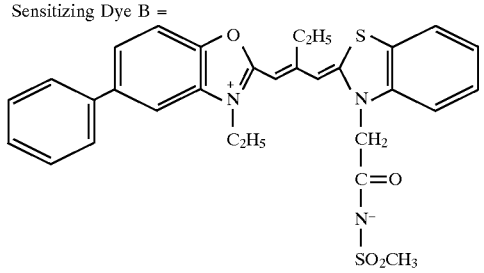

Compound A=Benzothiazolium, 5-6-dimethoxy-3-(3-sulfopropyl)-, inner salt

Chemical Sensitizer A=Sodium aurous(I) dithiosulfate dihydrate

Chemical Sensitizer B=Sodium thiosulfate pentahydrate

Compound B=4-Hydroxy-6-methyl-1,3,3a,7-tetraazaindene

Compound C =
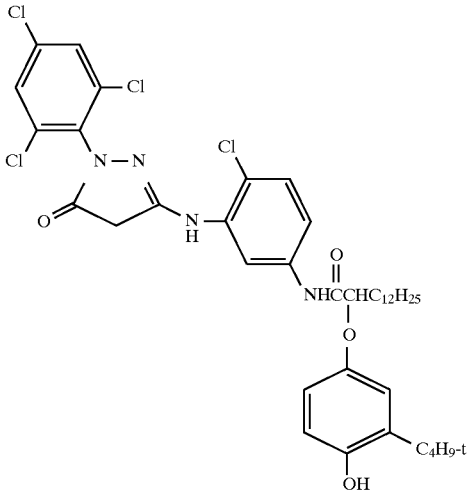
Compound D =
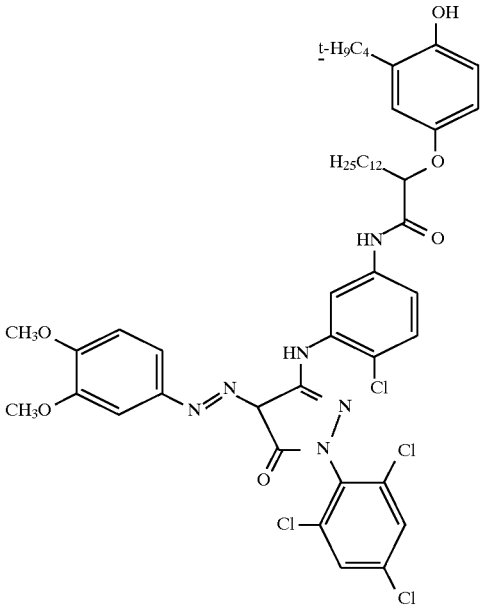
-continued
Compound E =
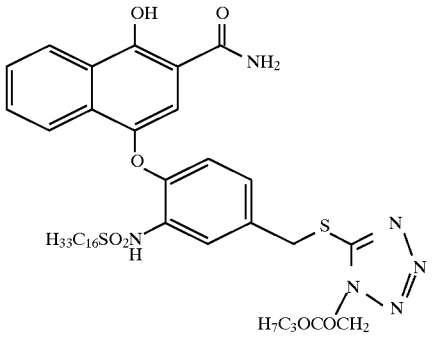
Compound F=Ethylenediamine complex of tetrachloropalladate
Compound G=Aurous sulfide
Compound H =
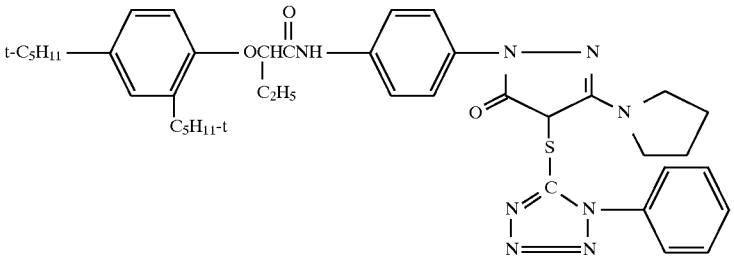

Compound I=Bis(sodium p-glutaramidophenyl) disulfide

Sensitizing Dye C =

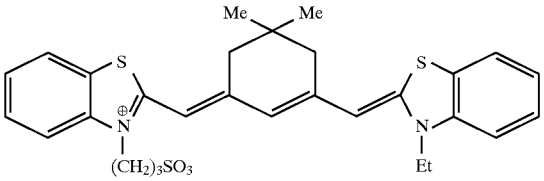

Example 1

A silver bromo-iodide (3.3 mol % iodide) cubic monodisperse emulsion (Emulsion A, comparison) with 0.2 micrometer cubic edge length was treated in the following way (all materials added per mol silver halide). The pH of the liquid emulsion was adjusted to 6.0 and the pAg to 8.2 at 43.3° C. To the liquid emulsion was added 0.72 mmol of a solid-in-gelatin dispersion of Sensitizing Dye A, followed after 20 minutes by 0.18 mmol of a solid-in-gelatin dispersion of Sensitizing Dye B. After 10 minutes, 25 mg of Compound A was added. After 2 minutes, 12 mg of Chemical Sensitizer A and 6 mg of Chemical Sensitizer B were added. The liquid emulsion was then heated for 10 minutes at 70° C. and cooled back to 43.3° C., then 1.75 g of Compound B was added.

Example 2

A silver bromo-iodide (3 mol % iodide) cubic monodisperse emulsion (Emulsion B, comparison) with 0.113 micrometer cubic edge length was treated in the following way (all materials added per mol silver halide). The pH of the liquid emulsion was adjusted to 6.0 and the pAg to 8.2 at 43.3° C. To the liquid emulsion was added 0.88 mmol of a solid-in-gelatin dispersion of Sensitizing Dye A, followed after 20 minutes by 0.22 mmol of a solid-in-gelatin dispersion of Sensitizing Dye B. After 10 minutes, 25 mg of Compound A was added. After 2 minutes, 37 mg of Chemical Sensitizer A and 18.5 mg of Chemical Sensitizer B were added. The liquid emulsion was then heated for 5 minutes at 62.2° C. and cooled back to 43.3° C., then 1.75 g of Compound B was added.

Example 3

The following emulsions were variations of the process described in Example 1 (all materials added per mol silver halide).

Emulsion A1 (invention) was prepared like Emulsion A of Example 1 except that 0.5 g of TSS/mole Ag and 0.05 g of TS/mole Ag were added simultaneously to the liquid emulsion after chemical sensitization.

Emulsion A2 (invention) was prepared like Emulsion A of Example 1 except that 1.0 g of TSS/mole Ag and 0.1 g of TS/mole Ag were added simultaneously to the liquid emulsion after chemical sensitization.

Emulsion A3 (invention) was prepared like Emulsion A of Example 1 except that 1.5 g of TSS/mole Ag and 0.15 g of TS/mole Ag were added simultaneously to the liquid emulsion after chemical sensitization.

Emulsion A4 (invention) was prepared like Emulsion A of Example 1 except that 2.0 g of TSS/mole Ag and 0.2 g of TS/mole Ag were added simultaneously to the liquid emulsion after chemical sensitization.

Coating Formulation, Exposure, and Development

The emulsions of Examples 1–3 were separately mixed with additional gelatin and water in preparation for coating. Each emulsion was co-mixed with equal volumes of a melt of conventional gelatin-oil dispersions of Compound C, Compound D, and Compound E containing 1.75 g Compound B/silver mol, $4.5\times10^{-2}$ mol Compound F/silver mol, and 0.52 mg Compound G/silver mol. The cooled emulsion layer was protected by a gelatin overcoat containing conventional coating surfactants and hardened with bis (vinylsulfonylmethyl)ether.

The resulting coatings on cellulose triacetate support contained 807.3 mg silver/$m^2$, 4305.6 mg gelatin/$m^2$, 645.8 mg Compound C/$m^2$, 75.3 mg Compound D/$m^2$, and 21.5 mg Compound E/$m^2$.

After hardening, the dried coatings were exposed through a graduated density tablet using a 5500K light source for 0.02 second, filtered with a Kodak Wratten 9 separation filter. The exposed coatings were processed for 3 minutes, 15 second in C-41 color negative process. The variation in photographic speed (logE) of all emulsions is measured at a density of 0.15 above minimum developed density and is relative to the photographic speed of the fastest emulsion.

TABLE I

| Emulsion | g TSS/ mole Ag | g TS/ mole Ag | ΔlogE | Contrast | D-min | D-max |
|---|---|---|---|---|---|---|
| A | 0 | 0 | 0 | 3.29 | 0.24 | 2.62 |
| B | 0 | 0 | -0.80 | 3.76 | 0.16 | 2.66 |
| A1 | 0.5 | 0.05 | -0.30 | 3.68 | 0.21 | 2.62 |
| A2 | 1.0 | 0.1 | -0.68 | 4.31 | 0.18 | 2.63 |
| A3 | 1.5 | 0.15 | -0.75 | 4.71 | 0.17 | 2.62 |
| A4 | 2.0 | 0.20 | -0.93 | 4.31 | 0.19 | 2.58 |

The data of Table I show that the speed adjustment of the larger-grained emulsion can be matched relative to the smaller-grained emulsion by the use of an appropriate amount of TSS and TS following the sensitization step without any significant deterioration in contrast or maximum developed density. The use of the inventive compounds in this manner also does not deleteriously affect the coated emulsion's storage properties following a one—week hold at 49° C.

Example 4

Emulsion C

This emulsion demonstrates the conventional cubic emulsion precipitated in low methionine gelatin and doped with 4.65 mg of Compound I for fresh fog control; 6 μg osmium/Ag mole (for contrast control); and with 0.02 mg iridium/Ag mole for reciprocity control.

A pure chloride silver halide emulsion was precipitated by equimolar addition of silver nitrate and sodium chloride into a well stirred reactor containing gelatin peptizer.

A reaction vessel contained 4.5 L of a solution that was 7.9% in low methionine gelatin, 0.038M in NaCl. The contents of the reaction vessel were maintained at 55° C. and the pCl was adjusted to 1.7. To this stirred solution at 55° C. 27.7 mL of a solution 2.6M in $AgNO_3$ and 26.9 mL of a solution 2.8M in NaCl were added simultaneously at 27.7 mL/min for 1 minute.

The 2.6M silver nitrate solution and the 2.8M sodium chloride solution were added simultaneously with a ramped linearly increasing flow from 27.7 mL/min to 123 mL/min over 20 minutes. The 2.6M silver nitrate solution and 2.8M sodium chloride solution were then added simultaneously at 123 mL/min for 40 minutes. The emulsion was cooled down to 40° C. over 5 minutes. The resulting emulsion was a cubic grain silver chloride emulsion of 0.4 μm in edgelength size. The emulsion was then washed using an ultrafiltration unit, and final pH and pCl were adjusted to 5.6 and 1.7 respectively.

Emulsion D

Same as Emulsion C except that emulsion was doped with 10 μg osmium/Ag mole and with 0.04 mg of iridium/Ag mole.

Emulsion E

Same as Emulsion C except that emulsion was doped with 0.18 mg of Compound I/Ag mole, with 3 μg osmium/Ag mole and with 0.05 mg iridium/Ag mole.

Emulsion F

Same as Emulsion C except that emulsion was doped with 0.04 mg iridium/Ag mole.

Example 5

Emulsion G

A tabular silver iodochloride emulsion was precipitated as follows:

A 4700 mL solution containing 0.7 percent by weight of low methionine gelatin, 0.0282 mol/L of sodium chloride was provided in a stirred reaction vessel. The contents of the reaction vessel were maintained at 40° C. and the pCl was adjusted to 2.3. The contents of the reaction vessel was then cooled to 33° C. To this stirred solution at 33° C. 31.5 mL of a solution 4.0M in $AgNO_3$ and 31.5 mL of a solution 4.0M in NaCl were added simultaneously at 45 mL/min for 0.7 minute. While this solution was vigorously stirred, 5.75 L of solution containing 0.0235 mol of potassium iodide and 0.0565 mol of sodium chloride was dumped followed by dump of 4.0 L of water. The mixture was then held for 20 minutes, the temperature remaining at 33° C. Following the hold, a 4.0M sodium chloride and 4.0M silver nitrate were added simultaneously at a rate 15.0 mL/min for 10 minutes. The 4.0M silver nitrate was added at a rate 15 mL/min for 20 minutes while 4.0M sodium chloride was added with a ramped linearly decreasing flow from 11.5 to 8.6 minutes over 20 minutes, the pCl was changed from 2.3 to 1.52 during this period of time. Finally, 4.0M silver nitrate solution and 4.0M sodium chloride solution were each added with a ramped linearly increasing flow from 30.0 mL/min to 37.5 mL/min over 40 minutes, the pCl being maintained at 1.52. The emulsion was then heated to 40° C., and then washed using an ultrafiltration unit, and its final pH and pCl were adjusted to 5.5 and 1.7, respectively.

The resulting emulsion was a silver iodochloride {100} tabular grain emulsion containing 0.383 mole percent iodide, based on silver. More than 60 percent of total projected area was provided by tabular grains having {100} major faces with an average ECD of 0.55 μm and an average thickness of 0.14 μm.

Example 6

Emulsion H

This emulsion demonstrates the conventional cubic emulsion doped with ruthenium.

A pure chloride silver halide emulsion was precipitated by equimolar addition of silver nitrate and sodium chloride into a well stirred reactor containing gelatin peptizer and an antifoaming pluronic agent.

A reaction vessel contained 6.9 L of a solution that was 3.9% in gelatin, and contained 1.71 g of pluronic antifoamant. The contents of the reaction vessel were maintained at 46° C. To this stirred solution at 46° C. 83.5 mL of 3.0M in NaCl was dumped and soon after 28.3 mL of dithiaoctanediol solution was poured into the reactor. A half minute after addition of dithiaoctanediol solution, 104.5 mL of a solution 2.8M in $AgNO_3$ and 107.5 mL of a solution 3.0M in NaCl were added simultaneously at 209 mL/min for 0.5 minute. The vAg set point was chosen equal to that observed in the reactor at this time. Then the 2.8M silver nitrate solution and the 3.0M sodium chloride solution were added simultaneously with a constant flow at 209 mL/min over 20.75 minutes. The resulting emulsion was a cubic grain silver chloride emulsion of 0.4 μm in edgelength size. The emulsion was then washed using an ultrafiltration unit, and final pH and pCl were adjusted to 5.6 and 1.7 respectively.

Sensitization, Coating Formulation, Exposure and Development

The emulsions were optimally sensitized by the customary techniques known in the art. In each finish where used, TSS and TS were added after both chemical or spectral sensitization were completed. Detailed procedures are described below for emulsions of Examples 7–14.

In magenta-sensitized emulsions Spectral Sensitizing Dye A was used.

Just prior to coating on resin coated paper support magenta sensitized emulsions were mixed with magenta dye forming coupler dispersion containing Coupler A or Coupler B.

Coupler A

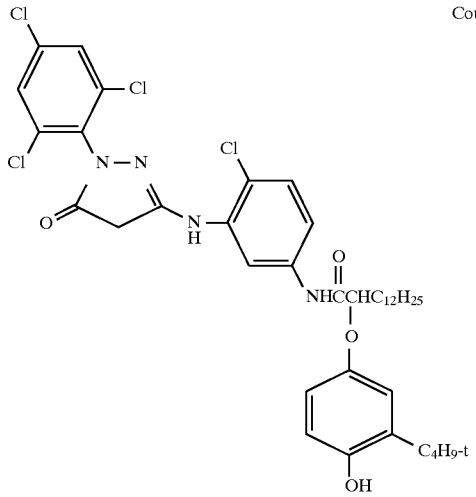

Coupler B

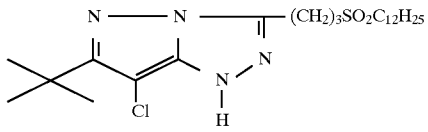

In cyan-sensitized emulsions the following cyan Spectral Sensitizing Dye was used:

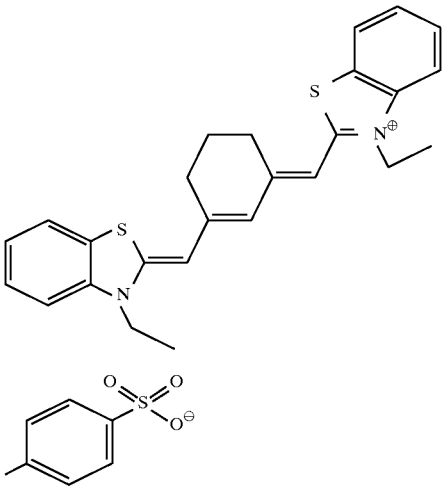

Just prior to coating on resin coated paper support the cyan sensitized emulsions were mixed with cyan dye forming coupler dispersion containing Coupler C.

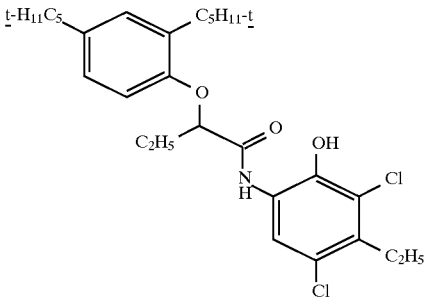

Coupler C

The magenta sensitized emulsions were coated at 10 mg silver per square foot with Coupler B or 26 mg silver per square foot with Coupler A, while the cyan sensitized emulsions were coated at 17 mg silver per square foot on resin-coated paper support. The coatings were overcoated with a gelatin layer and the entire coating was hardened with bis(vinylsulfonylmethyl)ether.

Coatings were exposed through a graduated density tablet with 3000K tungsten source at exposure time of 0.10 second.

All coatings were developed in RA-4 process.

Example 7

This example compares silver chloride cubic emulsions precipitated in low methionine gelatin and doped with 4.25 mg of Compound I/Ag mole, 6 $\mu$g osmium/Ag mole and 0.02 mg iridium/Ag mole during precipitation, and sensitized for magenta color record. The sensitization details were as follows:

Part 7.1:

A portion of silver chloride Emulsion C was optimally sensitized by the addition of the optimum amount of Spectral Sensitizing Dye A followed by addition of the optimum amount of colloidal gold sulfide. The emulsion was heated up to 60° C. for 30 minutes, and then was cooled down to 40° C. and 1-(3 -acetamidophenyl)-5-mercaptotetrazole was added followed by addition of soluble potassium bromide.

Part 7.2:

A portion of silver chloride Emulsion C was sensitized identically as in Part 7.1 except that 50 mg of TSS/mole Ag and 5 mg of TS/mole Ag were added simultaneously as the last addendum after the finish.

Part 7.3:

A portion of silver chloride Emulsion C was sensitized identically as in Part 7.1 except that 100 mg of TSS/mole Ag and 10 mg of TS/Ag mole were added simultaneously as the last addendum after the finish.

Part 7.4:

A portion of silver chloride Emulsion C was sensitized identically as in Part 7.1 except that 200 mg of TSS/mole Ag and 20 mg of TS/mole Ag were added simultaneously as the last addendum after the finish.

Part 7.5:

A portion of silver chloride Emulsion C was sensitized identically as in Part 7.1 except that 400 mg of TSS/mole Ag and 40 mg of TS/mole Ag were added simultaneously as the last addendum after the finish.

Sensitometric data are summarized in Table II.

TABLE II

| Emulsion Finish | TSS (mg/Ag mole) | TS (mg/Ag mole) | Speed @ D = 1.0 | $D_{min}$ | Toe | Shoulder | Contrast | Speed @ $D_{min}$ + 1.35 $10^{-2}$ s | $10^{-4}$ s |
|---|---|---|---|---|---|---|---|---|---|
| Part 7.1 | 0 | 0 | 190 | 0.125 | 0.328 | 2.130 | 1.968 | 179 | 181 |
| Part 7.2 | 50 | 5 | 183 | 0.122 | 0.300 | 2.132 | 2.047 | 173 | 171 |
| Part 7.3 | 100 | 10 | 176 | 0.116 | 0.294 | 2.084 | 2.071 | 162 | 160 |
| Part 7.4 | 200 | 10 | 170 | 0.116 | 0.304 | 2.080 | 2.040 | 156 | 151 |
| Part 7.5 | 400 | 40 | 165 | 0.120 | 0.309 | 2.060 | 2.049 | 150 | 145 |

Gold sulfide sensitized silver chloride cubic emulsions made in low methionine gelatin exhibit the desired effect of TSS and TS when added after chemical and spectral sensitizations in the magenta finish format Larger losses of speed due to the presence of TSS and TS when added to the already finished magenta emulsions are observed without causing substantial changes in reciprocity and in characteristic curve shape.

Example 8

This example compares silver chloride cubic emulsions precipitated in low methionine gelatin and doped with Compound I, osmium and iridium during precipitation, and sensitized with gold sulfide compounds for magenta color record. The sensitization details were as follows:

Part 8.1:

A portion of silver chloride Emulsion D was sensitized identically as in Part 7.1.

Part 8.2:

A portion of silver chloride Emulsion D was sensitized identically as in Part 7.1 except that 50 mg of TSS/mole Ag and 5 mg of TS/ mole Ag were added simultaneously as the last addendum after the finish.

Part 8.3:

A portion of silver chloride Emulsion D was sensitized identically as in Part 7.1 except that 100 mg of TSS/mole Ag and 10 mg TS/mole Ag were added simultaneously as the last addendum after the finish.

Part 8.4:

A portion of silver chloride Emulsion D was sensitized identically as in Part 7.1 except that 200 mg of TSS/mole Ag and 20 mg of TS/mole Ag were added simultaneously as the last addendum after the finish.

Part 8.5:

A portion of silver chloride Emulsion D was sensitized identically as in Part 7.1 except that 400 mg of TSS/mole Ag and 40 mg TS/mole Ag were added simultaneously as the last addendum after the finish.

Sensitometric data are summarized in Table III.

TABLE III

| Emulsion Finish | TSS (mg/Ag mole) | TS (mg/Ag mole) | Speed @ D = 1.0 | $D_{min}$ | Toe | Shoulder | Contrast | Speed @ $D_{min}$ + 1.35 $10^{-2}$ s | $10^{-4}$ s |
|---|---|---|---|---|---|---|---|---|---|
| Part 8.1 | 0 | 0 | 184 | 0.115 | 0.272 | 2.205 | 2.174 | 172 | 176 |
| Part 8.2 | 50 | 5 | 173 | 0.112 | 0.261 | 2.093 | 2.285 | 162 | 166 |
| Part 8.3 | 100 | 10 | 165 | 0.110 | 0.274 | 2.019 | 2.178 | 154 | 156 |
| Part 8.4 | 200 | 20 | 159 | 0.110 | 0.284 | 1.966 | 2.110 | 145 | 146 |
| Part 8.5 | 400 | 40 | 155 | 0.111 | 0.291 | 1.911 | 2.064 | 140 | 139 |

Gold sulfide sensitized silver chloride cubic emulsions made in low methionine gelatin exhibit the desired effect of TSS and TS when added after chemical and spectral sensitizations are completed when sensitized in the magenta finish format. Larger losses of speed due to the presence of TSS and TS are observed without causing substantial changes in reciprocity and in characteristic curve shape.

Example 9

This example compares silver chloride cubic emulsions precipitated in low methionine gelatin and doped with osmium and iridium during precipitation and sensitized for magenta color record. The sensitization details were as follows:

Part 9.1:

A portion of silver chloride Emulsion E was optimally sensitized by the addition of the optimum amount of Spectral Sensitizing Dye A followed by addition of the optimum amount of sulfur and followed by optimum amount of gold(I). The emulsion was heated up to 60° C. for 45 minutes. Then the emulsion was cooled down to 40° C. and 1-(3-acetamidophenyl)-5-mercaptotetrazole was added followed by addition of soluble potassium bromide.

Part 9.2:

A portion of silver chloride Emulsion E was sensitized identically as in Part 9.1 except that 10 mg of TSS/mole Ag and 1 mg of TS/mole Ag were added simultaneously as the last addendum after the finish.

Part 9.3:

A portion of silver chloride Emulsion E was sensitized identically as in Part 9.1 except that 20 mg of TSS/mole Ag and 2 mg of TS/mole Ag were added simultaneously as the last addendum after the finish.

Part 9.4:

A portion of silver chloride Emulsion E was sensitized identically as in Part 9.1 except that 40 mg of TSS/mole Ag and 4 mg of TS/mole Ag were added simultaneously as the last addendum after the finish.

Part 9.5:

A portion of silver chloride Emulsion E was sensitized identically as in Part 9.1 except that 60 mg of TSS/mole Ag and 6 mg of TS/mole Ag were added simultaneously as the last addendum after the finish.

Part 9.6:

A portion of silver chloride Emulsion E was sensitized identically as in Part 9.1 except that 80 mg of TSS/mole Ag and 8 mg of TA/mole Ag were added simultaneously as the last addendum after the finish.

Sensitometric data are summarized in Table IV.

TABLE IV

| Emulsion Finish | TSS (mg/Ag mole) | TS (mg/Ag mole) | Speed @ D = 1.0 | $D_{min}$ | Toe | Shoulder | Contrast | Speed @ $D_{min}$ + 1.35 $10^{-2}$ s | $10^{-4}$ s |
|---|---|---|---|---|---|---|---|---|---|
| Part 9.1 | 0 | 0 | 184 | 0.136 | 0.401 | 1.832 | 1.607 | 159 | 161 |
| Part 9.2 | 10 | 1 | 182 | 0.134 | 0.393 | 1.813 | 1.617 | 159 | 158 |
| Part 9.3 | 20 | 2 | 179 | 0.129 | 0.401 | 1.832 | 1.617 | 157 | 157 |
| Part 9.4 | 40 | 4 | 174 | 0.127 | 0.405 | 1.820 | 1.599 | 153 | 154 |
| Part 9.5 | 60 | 6 | 170 | 0.125 | 0.401 | 1.818 | 1.605 | 149 | 150 |
| Part 9.6 | 80 | 8 | 165 | 0.123 | 0.410 | 1.798 | 1.596 | 143 | 143 |

Sulfur and gold sensitized silver chloride cubic emulsions made in low methionine gelatin exhibit the desired effect of TSS and TS when added after chemical and magenta spectral sensitizations are completed. Larger losses of speed due to the presence of TSS and TS are observed without causing substantial changes in reciprocity and in characteristic curve shape.

Example 10

This example shows blending of silver chloride cubic emulsion made in low methionine gelatin and sensitized in magenta finish format (faster component) with silver chloride cubic emulsion made in oxidized gelatin and sensitized in magenta finish format in the presence of 1 g TSS/Ag mole and 0.1 g of TS/Ag mole added simultaneously as the last addendum after the finish.

Part 10.1:

A portion of silver chloride Emulsion C (faster component) was sensitized identically as in Part 7.1.

Part 10.2:

A 95% portion of silver chloride Emulsion C was sensitized identically as in Part 7.1. This was blended with a 5% portion of silver chloride Emulsion C sensitized identically as in Part 7.1, except that 1 g of TSS/mole Ag and 0.1 g of TS/mole Ag were added simultaneously as the last addendum after the finish.

Part 10.3:

A 90% portion of silver chloride Emulsion C was sensitized identically as in Part 7.1. This was blended with a 10% portion of silver chloride Emulsion C sensitized identically as in Part 7.1, except that 1 g of of TSS/mole Ag and 0.1 g of TS/mole Ag were added simultaneously as the last addendum after the finish.

Part 10.4:

A 80% portion of silver chloride Emulsion C was sensitized identically as in Part 7.1. This was blended with a 20% portion of silver chloride Emulsion C sensitized identically as in Part 7.1, except that 1 g of of TSS/mole Ag and 0.1 g of TS/mole Ag were added simultaneously as the last addendum after the finish.

Part 10.5:

A 10% portion of silver chloride Emulsion C was sensitized identically as in Part 7.1. This was blended with a 90% portion of silver chloride Emulsion C sensitized identically as in Part 7.1, except that 1 g of of TSS/mole Ag and 0.1 g of TS/mole Ag were added simultaneously as the last addendum after the finish.

Part 10.6:

A portion of silver chloride Emulsion C (slower component) was sensitized identically as in Part 7.1, except that 1 g of of TSS/mole Ag and 0.1 g of TS/mole Ag were added simultaneously as the last addendum after the finish.

Sensitometric data are summarized in Table V.

TABLE V

| Emulsion | % Component | Speed @ | | | | | Speed @ $D_{min}$ + 1.35 | |
|---|---|---|---|---|---|---|---|---|
| Finish | Fast:Slow | D = 1.0 | $D_{min}$ | Toe | Shoulder | Contrast | $10^{-2}$ s | $10^{-4}$ s |
| Part 10.1 | 100:0 | 187 | 0.116 | 0.306 | 2.155 | 1.935 | 173 | 173 |
| Part 10.2 | 95:5 | 184 | 0.112 | 0.288 | 2.169 | 2.043 | 169 | 168 |
| Part 10.3 | 90:10 | 180 | 0.112 | 0.291 | 2.145 | 2.056 | 164 | 162 |
| Part 10.4 | 80:20 | 173 | 0.108 | 0.293 | 2.097 | 2.080 | 155 | 152 |
| Part 10.5 | 10:90 | 169 | 0.113 | 0.306 | 2.079 | 2.054 | 149 | 143 |
| Part 10.6 | 0:100 | 167 | 0.114 | 0.302 | 2.070 | 2.073 | 148 | 144 |

The results in Table V show that the blends of fast and slow emulsions give similar characteristic curve shape and reciprocity but significantly different speed positions as a function of blend ratio.

Example 11

This example shows blending of silver chloride tabular emulsion made in low methionine gelatin and sensitized in magenta finish format (faster component) with silver chloride tabular emulsion made in low methionine gelatin and sensitized in magenta finish format in the presence of 1 g TSS/mole Ag and 0.1 g of TS/mole Ag added as the last addendum after the finish.

Part 11.1:

A portion of silver chloride Emulsion G (faster component) was sensitized identically as in Part 7.1.

Part 11.2:

A 95% portion of silver chloride Emulsion G was sensitized identically as in Part 7.1. This was blended with a 5% portion of silver chloride Emulsion G sensitized identically as in Part 7.1, except that 1 g of TSS/mole Ag and 0.1 g of TS/mole Ag were added simultaneously as the last addendum after the finish.

Part 11.3:

A 80% portion of silver chloride Emulsion G was sensitized identically as in Part 7.1. This was blended with a 20% portion of silver chloride Emulsion G sensitized identically as in Part 7.1, except that 1 g of TSS/mole Ag and 0.1 g of TS/mole Ag were added simultaneously as the last addendum after the finish.

Part 11.4:

A 70% portion of silver chloride Emulsion G was sensitized identically as in Part 7.1. This was blended with a 30% portion of silver chloride Emulsion G sensitized identically as in Part 7.1, except that 1 g of TSS/mole Ag and 0.1 g of TS/mole Ag were added simultaneously as the last addendum after the finish.

Part 11.5:

A 10% portion of silver chloride Emulsion G was sensitized identically as in Part 7.1. This was blended with a 90% portion of silver chloride Emulsion G sensitized identically as in Part 7.1, except that 1 g of TSS/mole Ag and 0.1 g of TS/mole Ag were added simultaneously as the last addendum after the finish.

Part 11.6:

A 5% portion of silver chloride Emulsion G was sensitized identically as in Part 7.1. This was blended with a 95% portion of silver chloride Emulsion G sensitized identically as in Part 7.1, except that 1 g of TSS/mole Ag and 0.1 g of TS/mole Ag were added simultaneously as the last addendum after the finish.

Part 11.7:

A portion of silver chloride Emulsion G (slower component) was sensitized identically as in Part 7.1, except that 1 g of TSS/mole Ag and 0.1 g of TS/mole Ag were added simultaneously as the last addendum after the finish.

Sensitometric data are summarized in Table VI.

TABLE VI

| Emulsion Finish | % Component Fast:Slow | Speed @ D = 1.0 | $D_{min}$ | Toe | Shoulder | Contrast | Speed @ $D_{min}$ + 1.35 $10^{-2}$ s | $10^{-4}$ s |
|---|---|---|---|---|---|---|---|---|
| Part 11.1 | 100:0 | 164 | 0.128 | 0.407 | 1.960 | 1.602 | 112 | 119 |
| Part 11.2 | 95:5 | 163 | 0.128 | 0.404 | 1.944 | 1.638 | 112 | 118 |
| Part 11.3 | 80:20 | 160 | 0.127 | 0.402 | 1.957 | 1.640 | 108 | 113 |
| Part 11.4 | 70:30 | 123 | 0.121 | 0.401 | 1.953 | 1.560 | 65 | 70 |
| Part 11.5 | 10:90 | 90 | 0.115 | 0.417 | 1.889 | 1.560 | 31 | 34 |
| Part 11.6 | 5:95 | 89 | 0.118 | 0.409 | 1.962 | 1.550 | 29 | 28 |
| Part 11.7 | 0:100 | 88 | 0.113 | 0.409 | 1.986 | 1.497 | 26 | 23 |

The results in Table VI show that the blends of fast and slow emulsions give similar characteristic curve shape and reciprocity but significantly different speed positions as a function of blend ratio.

Example 12

This example compares silver chloride cubic emulsions made in low methionine gelatin and sensitized for cyan color record. The sensitization details were as follows:

Part 12.1:

A portion of silver chloride Emulsion F was optimally sensitized by the addition of the optimum amount of a stilbene compound. The emulsion was then heated up to 65° C. and held for 10 minutes, followed by addition of the optimum amount of colloidal gold sulfide, followed by addition of Lippmann silver bromide, followed by addition of optimal amount of Cyan Spectral Sensitizing Dye, followed by addition of 1-(3-acetamidophenyl)-5-mercaptotetrazole. Then the emulsion was cooled down to 40° C.

Part 12.2:

A portion of silver chloride Emulsion F was sensitized identically as in Part 12.1 except that 100 mg of TSS/mole Ag and 10 mg of TS/mole Ag were added simultaneously as the last addendum after the finish.

Part 12.3:

A portion of silver chloride Emulsion F was sensitized identically as in Part 12.1 except that 200 mg of TSS/mole Ag and 20 mg of TS/mole Ag were added simultaneously as the last addendum after the finish.

Part 12.4:

A portion of silver chloride Emulsion F was sensitized identically as in Part 12.1 except that 400 mg of TSS/mole Ag and 40 mg of TS/mole Ag were added simultaneously as the last addendum after the finish.

Part 12.5:

A portion of silver chloride Emulsion F was sensitized identically as in Part 12.1 except that 800 mg of TSS/mole Ag and 80 mg of TS/mole Ag were added simultaneously as the last addendum after the finish.

Part 12.6:

A portion of silver chloride Emulsion F was sensitized identically as in Part 12.1 except that 1200 mg of TSS/mole Ag and 120 mg of TS/mole Ag were added simultaneously as the last addendum after the finish.

Sensitometric data are summarized in Table VII.

TABLE VII

| Emulsion Finish | TSS (mg/Ag mole | TS (mg/Ag mole) | Speed @ D = 1.0 | $D_{min}$ | Toe | Shoulder | Contrast | Speed @ Dmin + 1.35 $10^{-2}$s | $10^{-4}$s |
|---|---|---|---|---|---|---|---|---|---|
| Part 12.1 | 0 | 0 | 188 | 0.122 | 0.280 | 2.167 | 2.065 | 101 | 99 |
| Part 12.2 | 100 | 10 | 171 | 0.122 | 0.303 | 2.286 | 1.995 | 81 | 81 |
| Part 12.3 | 200 | 20 | 161 | 0.121 | 0.293 | 2.231 | 2.040 | 76 | 75 |
| Part 12.4 | 400 | 40 | 155 | 0.119 | 0.312 | 2.234 | 1.964 | 68 | 67 |
| Part 12.5 | 800 | 80 | 151 | 0.121 | 0.281 | 2.217 | 2.036 | 64 | 61 |
| Part 12.6 | 1200 | 120 | 137 | 0.120 | 0.288 | 2.158 | 2.084 | 52 | 50 |

Presence of TSS and TS in the already finished gold sulfide sensitized, cyan silver chloride cubic emulsion precipitated in low methionine gelatin significantly decreases the speed of the emulsion without changing reciprocity and characteristic curve shape.

Example 13

This example compares silver chloride cubic emulsions sensitized for cyan color record. The sensitization details were as follows:

Part 13.1:

A portion of silver chloride Emulsion H was optimally sensitized by the addition of the optimum amount of a stilbene compound. The emulsion was then heated up to 65° C. and held for 10 minutes, followed by addition of Lippmann silver bromide, followed by optimal addition of gold (I), followed by addition of optimal amount of sulfur. Then optimal amount of Cyan Spectral Sensitizing Dye was added, followed by addition of 1-(3-acetamidophenyl)-5-mercaptotetrazole. Then the emulsion was cooled down to 40° C.

Part 13.2:

A portion of silver chloride Emulsion H was sensitized identically as in Part 13.1 except that 100 mg of TSS/mole Ag and 10 mg of TS/mole Ag were added simultaneously as the last addendum after the finish.

Part 13.3:

A portion of silver chloride Emulsion H was sensitized identically as in Part 13.1 except that 200 mg of TSS/mole Ag and 20 mg of TS/mole Ag were added simultaneously as the last addendum after the finish.

Part 13.4:

A portion of silver chloride Emulsion H was sensitized identically as in Part 13.1 except that 400 mg of TSS/mole Ag and 40 mg of TS/mole Ag were added simultaneously as the last addendum after the finish.

Part 13.5:

A portion of silver chloride Emulsion H was sensitized identically as in Part 13.1 except that 800 mg of TSS/mole Ag and 80 mg of TS/mole Ag were added simultaneously as the last addendum after the finish.

Part 13.6:

A portion of silver chloride Emulsion H was sensitized identically as in Part 13.1 except that 1200 mg of TSS/mole Ag and 120 mg of TS/mole Ag were added simultaneously as the last addendum after the finish.

Part 13.7:

A portion of silver chloride Emulsion H was sensitized identically as in Part 13.1 except that 2000 mg of TSS/mole Ag and 200 mg of TS/mole Ag were added simultaneously as the last addendum after the finish.

Sensitometric data are summarized in Table VIII.

TABLE VIII

| Emulsion Finish | TSS (mg/Ag mole) | TS (mg/Ag mole) | Speed @ D = 1.0 | $D_{min}$ | Toe | Shoulder | Contrast | Speed @ $D_{min}$ + 1.35 $10^{-2}$ s | Speed @ $D_{min}$ + 1.35 $10^{-4}$ s |
|---|---|---|---|---|---|---|---|---|---|
| Part 13.1 | 0 | 0 | 187 | 0.113 | 0.346 | 2.193 | 1.697 | 98 | 106 |
| Part 13.2 | 100 | 10 | 172 | 0.113 | 0.356 | 2.248 | 1.963 | 85 | 91 |
| Part 13.3 | 200 | 20 | 170 | 0.110 | 0.326 | 2.259 | 1.812 | 81 | 89 |
| Part 13.4 | 400 | 40 | 166 | 0.112 | 0.331 | 2.304 | 1.797 | 80 | 87 |
| Part 13.5 | 800 | 80 | 163 | 0.112 | 0.326 | 2.322 | 1.809 | 79 | 86 |
| Part 13.6 | 1200 | 120 | 161 | 0.113 | 0.327 | 2.339 | 1.774 | 77 | 84 |
| Part 13.7 | 2000 | 200 | 148 | 0.111 | 0.326 | 2.329 | 1.782 | 66 | 74 |

Gold(I) sulfur-sensitized silver chloride cubic emulsions exhibit the desired effect of TSS and TS when added after chemical and spectral sensitizations are completed. Larger losses of speed due to the presence of TSS and TS in the already finished cyan emulsions are observed without causing substantial changes in reciprocity and in characteristic curve shape.

Example 14

This example shows blending of silver chloride cubic emulsion sensitized in cyan finish format (faster component) with silver chloride cubic emulsion sensitized in cyan finish format in the presence of 1 g TSS/mole Ag and 0.1 g TS/mole Ag added as the last addendum after the finish.

Part 14.1:

A portion of silver chloride Emulsion H (faster component) was sensitized identically as in Part 13.1.

Part 14.2:

A 90% portion of silver chloride Emulsion H was sensitized identically as in Part 13.1. This was blended with a 10% portion of silver chloride Emulsion H sensitized identically as in Part 13. 1, except that 1 g of TSS/mole Ag and 0.1 g of TS/mole Ag were added simultaneously as the last addendum after the finish.

Part 14.3:

A 80% portion of silver chloride Emulsion H was sensitized identically as in Part 13.1. This was blended with a 20% portion of silver chloride Emulsion H sensitized identically as in Part 13.1, except that 1 g of TSS/mole Ag and 0.1 g of TS/mole Ag were added simultaneously as the last addendum after the finish.

Part 14.4:

A 70% portion of silver chloride Emulsion H was sensitized identically as in Part 13.1. This was blended with a 30% portion of silver chloride Emulsion H sensitized identically as in Part 13.1, except that 1 g of TSS/mole Ag and 0.1 g of TS/mole Ag were added simultaneously as the last addendum after the finish.

Part 14.5:

A 50% portion of silver chloride Emulsion H was sensitized identically as in Part 13.1. This was blended with a 50% portion of silver chloride Emulsion H sensitized identically as in Part 13.1, except that 1 g of TSS/mole Ag and 0.1 g of TS/mole Ag were added simultaneously as the last addendum after the finish.

Part 14.6:

A 40% portion of silver chloride Emulsion H was sensitized identically as in Part 13.1. This was blended with a 60% portion of silver chloride Emulsion H sensitized identically as in Part 13.1, except that 1 g of TSS/mole Ag and 0.1 g of TS/mole Ag were added simultaneously as the last addendum after the finish.

Part 14.7:

A 30% portion of silver chloride Emulsion H was sensitized identically as in Part 13.1. This was blended with a 70% portion of silver chloride Emulsion H sensitized identically as in Part 13.1, except that 1 g of TSS/mole Ag and 0.1 g of TS/mole Ag were added simultaneously as the last addendum after the finish.

Part 14.8:

A 20% portion of silver chloride Emulsion H was sensitized identically as in Part 13.1. This was blended with an 80% portion of silver chloride Emulsion H sensitized identically as in Part 13.1, except that 1 g of TSS/mole Ag and 0.1 g of TS/mole Ag were added simultaneously as the last addendum after the finish.

Part 14.9:

A 10% portion of silver chloride Emulsion H was sensitized identically as in Part 13.1. This was blended with a 90% portion of silver chloride Emulsion H sensitized identically as in Part 13.1, except that 1 g of TSS/mole Ag and 0.1 g of TS/mole Ag were added simultaneously as the last addendum after the finish.

Part 14.10:

A portion of silver chloride Emulsion H (slower component) was sensitized identically as in Part 13.1, except that 1 g of TSS/mole Ag and 0.1 g of TS/mole Ag were added simultaneously as the last addendum after the finish.

Sensitometric data are summarized in Table IX.

TABLE IX

| Emulsion Finish | % Component Fast:Slow | Speed @ D = 1.0 | $D_{min}$ | Toe | Shoulder | Contrast | Speed @ $D_{min}$ + 1.35 $10^{-2}$ s | $10^{-4}$ s |
|---|---|---|---|---|---|---|---|---|
| Part 14.1 | 100:0 | 174 | 0.114 | 0.350 | 2.171 | 1.702 | 92 | 99 |
| Part 14.2 | 90:10 | 154 | 0.113 | 0.355 | 2.202 | 1.658 | 74 | 81 |
| Part 14.3 | 80:20 | 147 | 0.112 | 0.355 | 2.112 | 1.657 | 67 | 74 |
| Part 14.4 | 70:30 | 144 | 0.111 | 0.355 | 2.090 | 1.628 | 66 | 72 |
| Part 14.5 | 50:50 | 142 | 0.114 | 0.361 | 2.071 | 1.669 | 62 | 71 |
| Part 14.6 | 40:60 | 138 | 0.112 | 0.359 | 2.081 | 1.630 | 58 | 66 |
| Part 14.7 | 30:70 | 136 | 0.114 | 0.354 | 2.107 | 1.668 | 58 | 65 |
| Part 14.8 | 20:80 | 134 | 0.114 | 0.348 | 2.202 | 1.678 | 56 | 63 |
| Part 14.9 | 10:90 | 131 | 0.113 | 0.338 | 2.179 | 1.701 | 54 | 61 |
| Part 14.10 | 0:100 | 128 | 0.113 | 0.337 | 2.207 | 1.707 | 52 | 59 |

The results in Table IX show that the blends of fast and slow emulsions give similar characteristic curve shape and reciprocity but significantly different speed positions as a function of blend ratio.

The invention has been described in detail with particular reference to certain preferred embodiments thereof, but it will be understood that variations and modifications can be effected within the spirit and scope of the invention.

We claim:

1. A photographic negative film comprising at least two photographic emulsions wherein said at least two emulsions are the same emulsion and wherein at least one of said at least two same emulsions is treated with a speed decreasing compound of Formula I:

$$Z^1—X^1O_2S—M^1 \quad (I)$$

and a compound of Formula II:

$$Z^2—X^2O_2—M^2 \quad (II)$$

wherein $X^1$ is sulfur and $X^2$ is selected from the group consisting of sulfur and selenium, $M^1$ and $M^2$ are independently selected from group consisting of a metal ion and

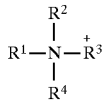

wherein $R^1$, $R^2$, $R^3$ and $R^4$ are independently selected from the group consisting of hydrogen and an alkyl of 1–3 carbon atoms, and $Z^1$ and $Z^2$ are independently selected from the group consisting of an unsubstituted or substituted alkyl of 1 to 18 carbon atoms, an unsubstituted or substituted aryl group having 6 to 10 carbon atoms, an unsubstituted or substituted 5-membered or 6-membered heterocyclic group having one or two heteroatoms, and L, wherein L is a divalent linking group, provided that, if $Z^1$ is L, the compound of Formula I is a polymer and, if $Z^2$ is L, the compound of Formula II is a polymer, such that after said treating at least one of said same emulsions has a different sensitivity.

2. The element of claim 1 wherein the at least two emulsions with different sensitivity are in a single color record.

3. The element of claim 1 wherein in the photographic emulsion, the compound of Formula I is present in about $1\times10^{-2}$ g to about 50 g per mole silver, and the compound of Formula II is present at about $1\times10^{-2}$ g to about 50 g per mole silver, provided that, if $Z^1$ is L, each polymeric unit comprising the moiety of formula $—X^1O_2S—$ is counted as a molecule of the compound of Formula I and, if $Z^2$ is L, each polymeric unit comprising the moiety of formula $—X^2O_2—$ is counted as a molecule of the compound of Formula II.

4. The element of claim 1 wherein $X^1$ and $X^2$ are sulfur, $M^1$ and $M^2$ are independently selected from $Na^+$, $K^+$ and

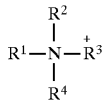

and $Z^1$ and $Z^2$ are independently selected from an unsubstituted phenyl group or a phenyl group substituted in one or two positions independently with a functional group selected from the group consisting of an alkyl having 1 to 10 carbon atoms, an alkoxy having 1 to 10 carbon atoms, an acyl having 1 to 10 carbon atoms, an hydroxyl, a phenyl, a tolyl, a naphthyl, a carboxy, a chloro, a bromo, a nitro, a cyano, an acetamido, a carbamoyl, an ureido, an unsubstituted amino, and an amino substituted with one or two alkyls being the same or different and each having 1 to 3 carbon atoms.

5. The element of claim 1 wherein said speed decreasing compound comprises greater than $1\times10^{-2}$ g per mol of silver.

6. The element of claim 1 wherein said speed decreasing compound comprises greater than $1\times10^{-1}$ g per mol of silver.

7. The photographic element of claim 1 wherein said at least two emulsions have a COV of less than 10 percent.

8. A method of sensitization of emulsions for negative film comprising forming at least two emulsions that are the same emulsion, adding chemical sensitizers and heating to sensitize said at least two same emulsions, adding speed decreasing compound to at least one of said emulsions, wherein said speed decreasing compound is present in an amount to provide greater than 0.1 log E decrease in speed in one of said emulsions wherein speed decreasing compound comprises Formula I $$Z^1—X^1O_2S—M^1 \quad (I)$$

and a compound of Formula II:

$$Z^2—X^2O_2—M^2 \quad (II)$$

wherein $X^1$ is sulfur and $X^2$ is selected from the group consisting of sulfur and selenium, $M^1$ and $M^2$ are independently selected from group consisting of a metal ion and

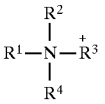

wherein $R^1$, $R^2$, $R^3$ and $R^4$ are independently selected from the group consisting of hydrogen and an alkyl of 1–3 carbon atoms, and $Z^1$ and $Z^2$ are independently selected from the group consisting of an unsubstituted or substituted alkyl of 1 to 18 carbon atoms, an unsubstituted or substituted aryl group having 6 to 10 carbon atoms, an unsubstituted or substituted 5-membered or 6-membered heterocyclic group having one or two heteroatoms, and L, wherein L is a divalent linking group, provided that, if $Z^1$ is L, the compound of Formula I is a polymer and, if $Z^2$ is L, the compound of Formula II is a polymer wherein after adding said speed decreasing compound at least one of said same emulsions has a different sensitivity.

9. The method of claim 8 wherein said speed decreasing compound is present in an amount of between $1\times10^{-1}$ g and 10 g per silver mol.

10. The method of claim 9 wherein said chemical sensitizers are selected from the group consisting of gold sulfide, soluble gold (I), and soluble gold (III).

11. The method of claim 8 wherein $X^1$ and $X^2$ are sulfur, $M^1$ and $M^2$ are independently selected from $Na^+$, $K^+$ and

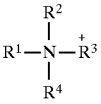

and $Z^1$ and $Z^2$ are independently selected from an unsubstituted phenyl group or a phenyl group substituted in one or two positions independently with a functional group selected from the group consisting of an alkyl having 1 to 10 carbon atoms, an alkoxy having 1 to 10 carbon atoms, an acyl having 1 to 10 carbon atoms, an hydroxyl, a phenyl, a tolyl, a naphthyl, a carboxy, a chloro, a bromo, a nitro, a cyano, an acetamido, a carbamoyl, an ureido, an unsubstituted amino, and an amino substituted with one or two alkyls being the same or different and each having 1 to 3 carbon atoms.

* * * * *